US005139207A

United States Patent [19]

Meschi

[11] Patent Number: 5,139,207

[45] Date of Patent: Aug. 18, 1992

[54] UNWINDING DEVICE FOR PAPER REELS

[75] Inventor: Luciano Meschi, Castiglioncello, Italy

[73] Assignee: Industria Grafica Meschi, Srl., Livorno, Italy

[21] Appl. No.: 482,229

[22] Filed: Feb. 20, 1990

[30] Foreign Application Priority Data

Feb. 22, 1989 [IT] Italy ..... 19532 A/89

[51] Int. Cl.[5] ..... B65H 16/02

[52] U.S. Cl. ..... 242/55

[58] Field of Search ..... 242/55, 68.7, 78.7, 242/76

[56] References Cited

U.S. PATENT DOCUMENTS

| | | | |
|---|---|---|---|
| 2,731,213 | 1/1956 | Groll | 242/78.7 |
| 3,416,051 | 12/1968 | Pinto et al. | 242/75.51 |
| 3,931,940 | 1/1976 | Raighn et al. | 242/56 R |
| 4,298,173 | 11/1981 | Johansson | 242/58 |
| 4,550,883 | 11/1985 | Boss | 242/55 X |
| 4,667,890 | 5/1987 | Gietman, Jr. | 242/55 |
| 4,676,496 | 6/1987 | Hanegger | 242/55 X |
| 4,681,273 | 7/1987 | Futagawa | 242/55 |
| 4,757,951 | 7/1988 | Ludszeweit | 242/58.1 |
| 4,901,935 | 2/1990 | Reist | 242/68.7 |

FOREIGN PATENT DOCUMENTS

| | | | |
|---|---|---|---|
| 60-48857 | 3/1985 | Japan | 242/67.1 R |
| 228453 | 1/1990 | Japan | 242/55 |
| 2077787 | 12/1981 | United Kingdom . | |

*Primary Examiner*—Daniel P. Stodola
*Assistant Examiner*—John P. Darling
*Attorney, Agent, or Firm*—McAulay Fisher Nissen Goldberg & Kiel

[57] ABSTRACT

An unwinding device comprises a number of elastic belts forming a loop within which the paper reel abuts. The translating motion of the belts causes the unwinding of the paper reel by friction.

27 Claims, 10 Drawing Sheets

UNWINDING DEVICE FOR PAPER REELS

The present invention relates to the handling of paper reels and more specifically to an unwinding device for paper reels.

It is known that a number of printing machines is fed with paper in a form of reels, and these reels have not a negligible size and above all a considerable weight, the latter possibly being of several hundred kilograms.

To date, unwinding systems for these type of reels have been adopted which essentially comprise motor driven mandrels which are inserted within a center axial hole of the reel and are driven at an adjusted speed so as to obtain an essentially constant linear speed of the paper band being unwound from the reel.

It is evident that as the diameter of the reel changes, the rotation speed of the mandrel must be adjusted in a controlled manner, in order to fulfill the above requisite. These various needs have raised and raise not negligible problems for the solution of which it has been necessary to have recourse to complex and delicate mechanisms both from the structure and from the actuation and control points of view.

As a matter of fact, from one side the relevant weight of the reel which is thus supported in a cantilevered manner from the mandrel involves the adoption of very resistant and heavy structural members in order to obtain the necessary mechanical strength, whereas the careful speed adjustment, especially if depending on the receiving machine positioned downstream, such as for example a laser printer, makes it necessary to use control and adjustment devices, which are complicated and by themselves delicate, especially if of electronic type.

In this connection further complications arise such as the relevant inertia of the reels whereby when, for a whatsoever reason, the unwinding of the reel must be stopped, the headway of the reel causes relevant forces to be applied to the mandrel and to the related supporting structure, or the paper unwinding must be continued; this paper has to be in some manner temporarily collected, for example, by means of reserve devices, and the paper has to be thereafter fed when the machine is positioned downstream and starts again to call for or require the paper.

Another problem to be solved is that of providing the so-called paper alignment, namely the alignment of either edge of the paper band being unwound from the reel with the next machine fed with the band. As a matter of fact this paper band, possibly already provided with suitable dragging holes along the edges must be fed at high rate for (for example at a speed corresponding to almost two sheets per second), machines like the so-called laser printers.

It is evident that, whatever obstacle hinders the paper band advancement, such obstacle may lead to a reduction in the operating rate of the printer to the detriment of the production rate of the whole line, which may consist in an electronic accounting or billing center, such as the invoice emitting centers of companies supplying public utility type of services (electricity, telephone, and the like).

The main purpose of the present invention is that of solving all the problems and drawbacks as above shortly mentioned. A more specific purpose of the present invention is that of achieving the above stated purpose by means of a device having a simple and effective structure and operation, by which the requirements of the machines being fed downstream can be flexibly met.

These purposes are achieved by means of an unwinding device for paper reels characterized by comprising, in its essence, at least one belt of a material having some elasticity, the reel to be unwound abutting with a predetermined force against a surface of the belt, and means for driving said at least one belt with a motion having a predetermined and an adjustable speed contacting with friction a predetermined surface portion of said reel, the free edge of the paper band forming said reel being directed in the motion direction of said at least one belt.

According to a first embodiment of the unwinding device said at least one belt comprises a number of parallel and spaced belts, each forming a closed circuit and provided with at least a pair of end rollers, one first of which is coupled to a motor rotation means whereas the second is an idle roller, the distance between the rollers of said pair being less than half the of each belt by a predetermined amount so as to form a loop or cradle within which said reel is freely abutting, said predetermined amount being moreover selected as a function of the elasticity of the material forming said belts and of the friction coefficient between the belt surface and the paper forming the reel.

According to a variation of said first embodiment roller means are positioned between said belts, said roller means having an axle with an axis parallel to the motion direction of said belts and being freely rotatable, said roller means being displaceable between a first rest or lowered position, in which the upper generating line of the roller means is at a height less than the lowest point of said cradle formed by said belts and a second operating raised position in which said reel is lifted by said roller means, it being thus disengaged from the upper surface of said belts.

According to a further embodiment the unwinding device of the invention is provided with abutments sidewise positioned with respect to said parallel belts, against which said reel freely abuts, whereby it is supported without any constraint, especially during the unwinding starting from a full reel.

According to a preferred embodiment of the invention the surface, as defined by the belts by which the paper is unwound from the reel, is inclined towards one side, namely orthogonally to the motion direction of the belts, whereby the paper reel abutting within the loop defined by the above surface is pushed towards said side of the device whereby the paper band unwound from the reel comes out of the device in a strictly aligned condition with the same above defined side, which shall be coincident and thus aligned with the entry line of the machine positioned downstream of the unwinding device.

The specific features and advantages of the present invention shall appear more clearly from the following detailed description, relating to the enclosed drawings, wherein.

Figure 1:
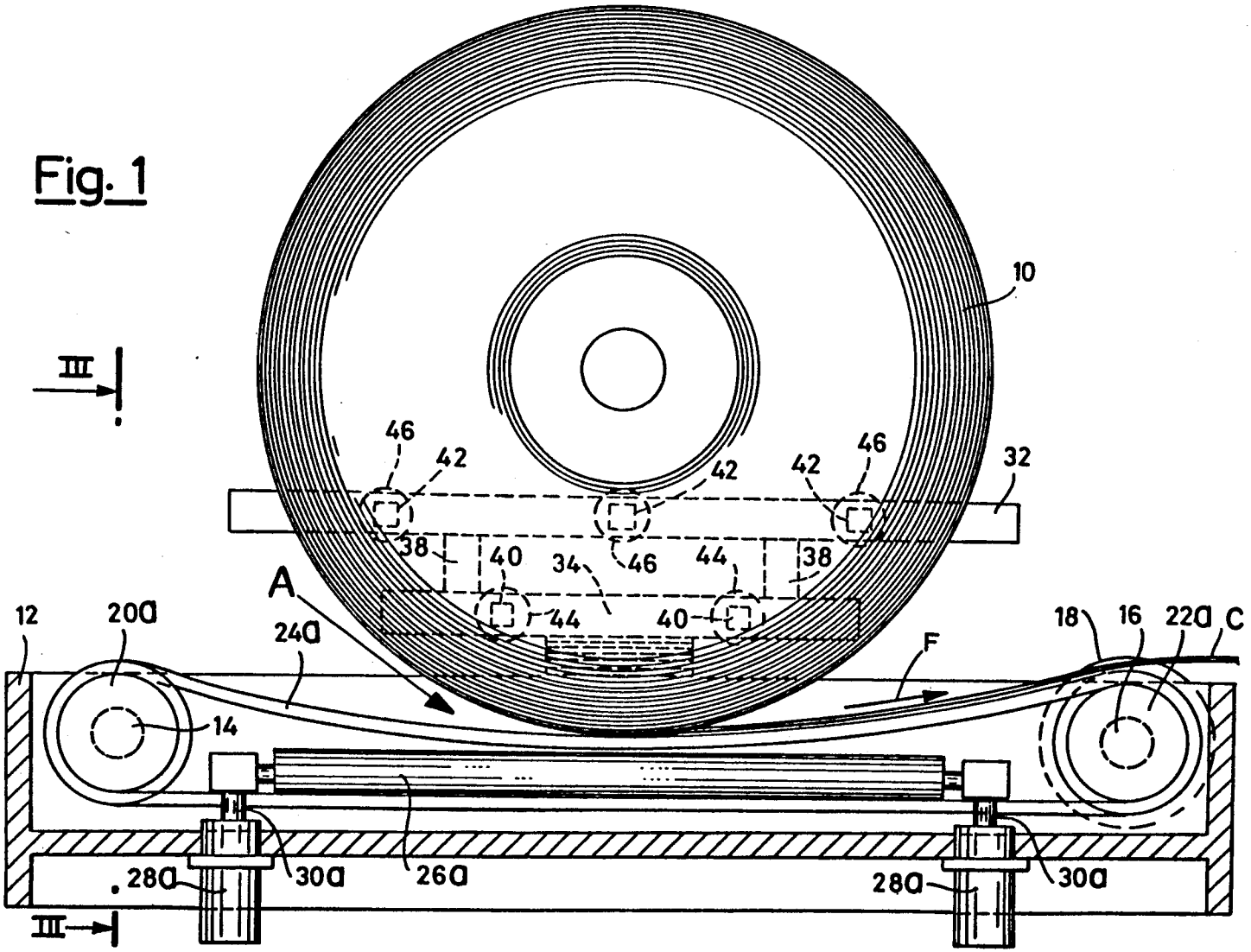
FIG. 1 is a side elevation view, partially cross-sectioned, of the unwinding device according to the invention.
Figure 2:
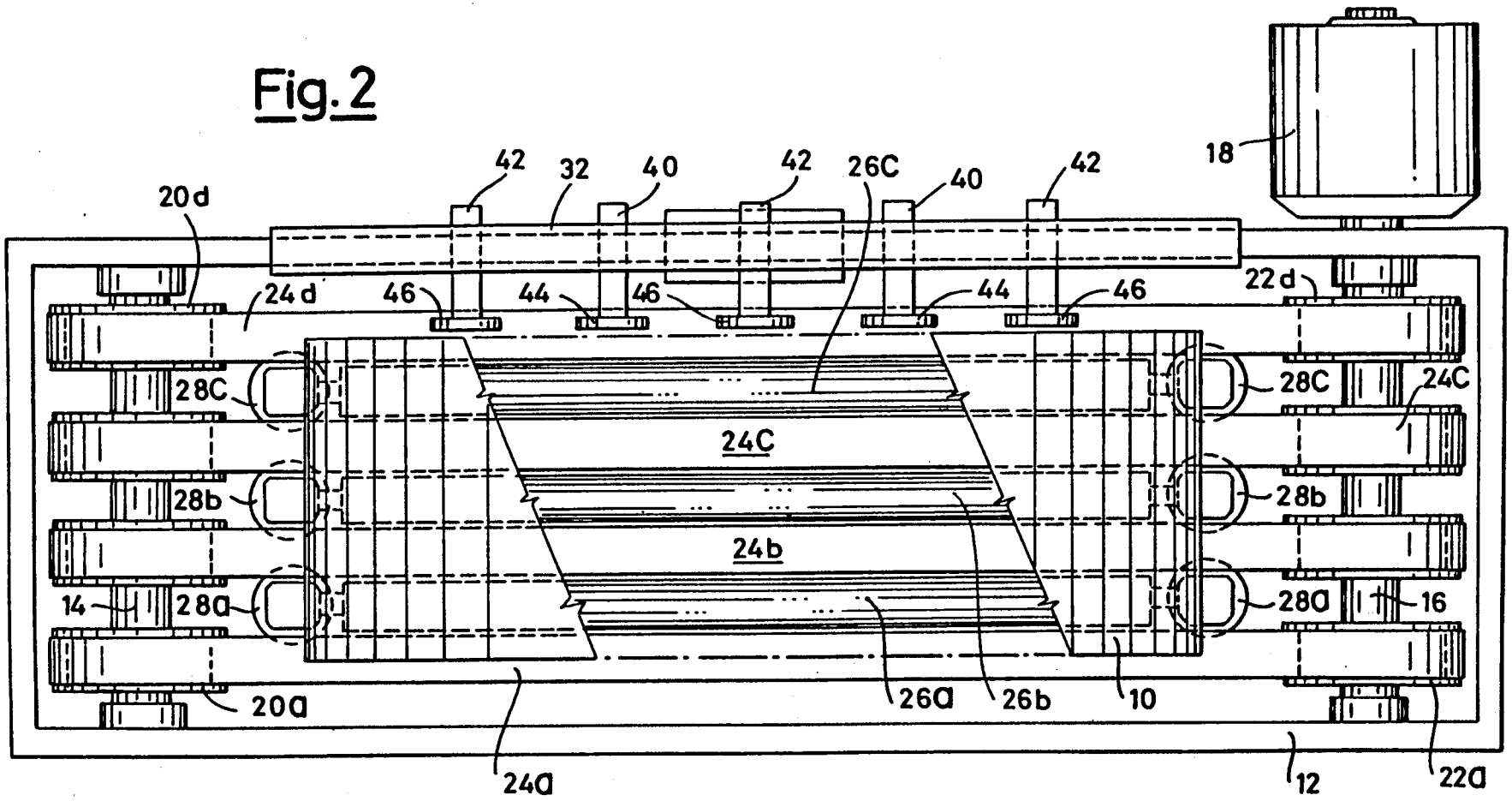
FIG. 2 is a plan view from above of FIG. 1.
Figure 3:
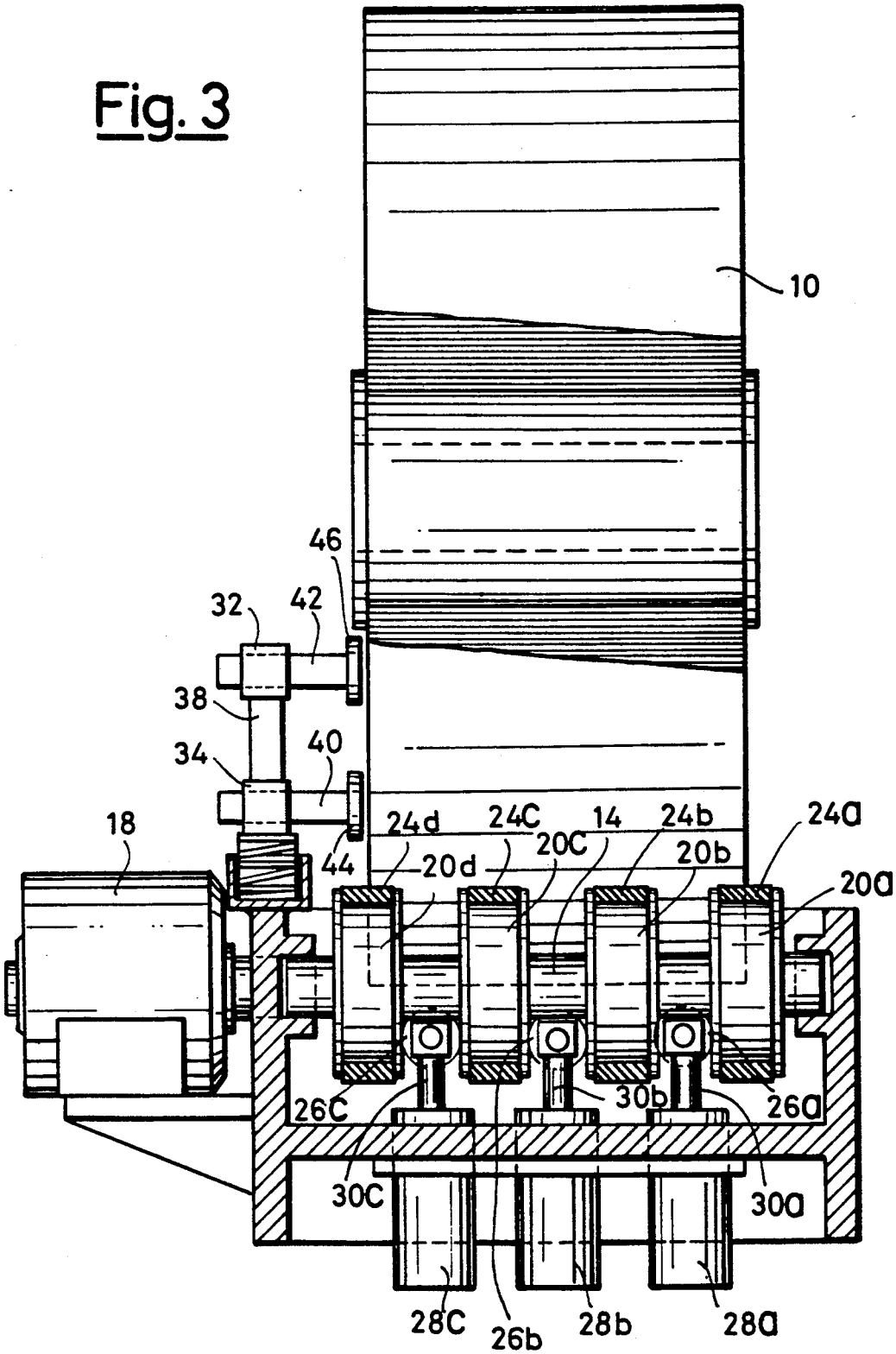
FIG. 3 is a cross-section view according to the lines III—III of FIG. 1.
Figure 4:
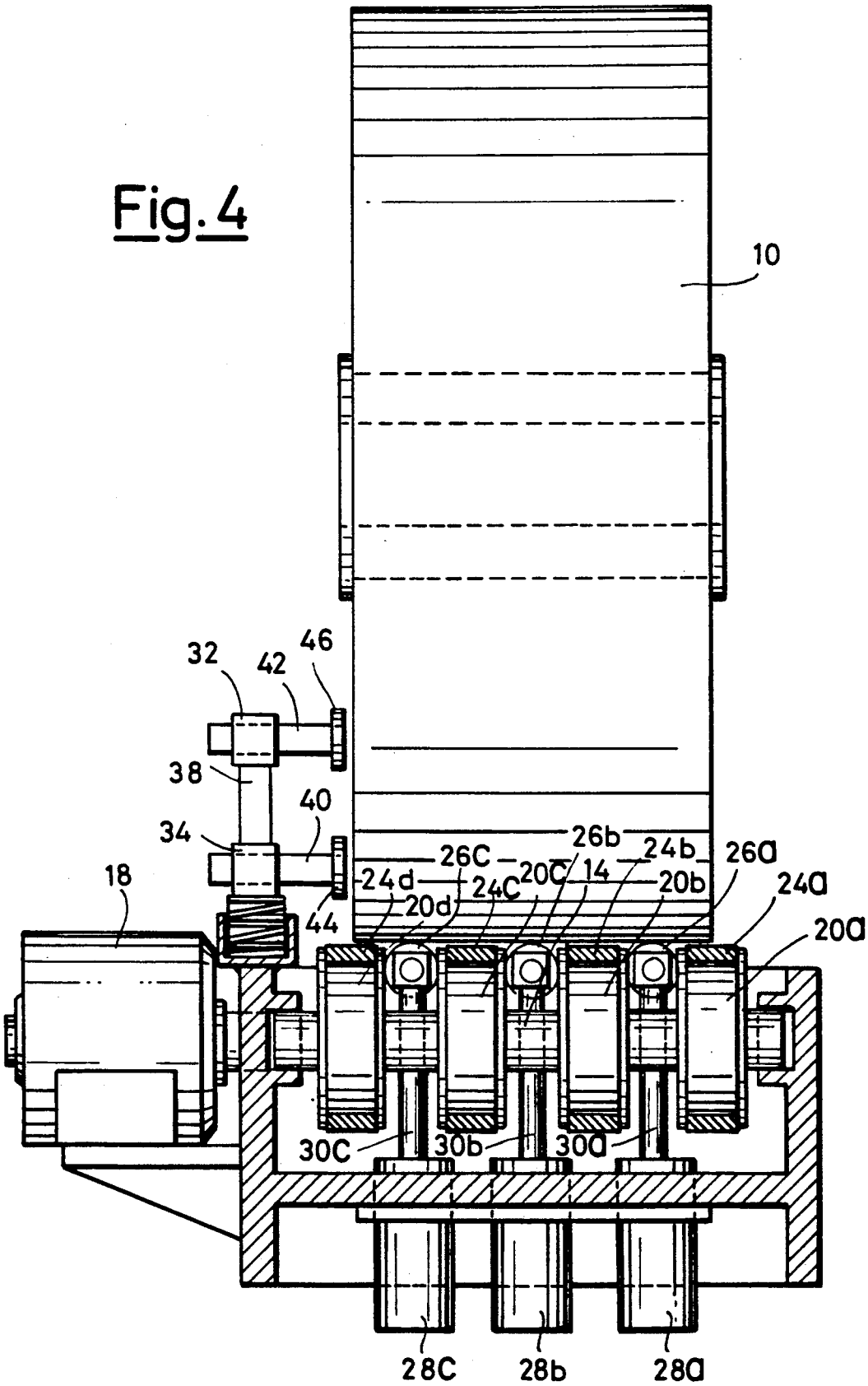
FIG. 4 is a view like FIG. 3 showing the reel unwinding device in a different operating condition.

Referring to the drawings, the device for the unwinding of paper reels, generically indicated by the reference 10, comprises a basement or frame 12, which at boths ends rotatably supports two axles or rollers 14, 16, the second of which is operatingly coupled to a driving motor 18, for example through suitable and not shown means of mechanical transmission of motion and of adjustment of the rotation speed of the roller 16, for example by means of a gearing. Each roller 14, 16 has mounted thereto a number of spools, which in the embodiment shown in FIGS. 1 to 4 are four for each roller and are indicated by the references 20*a*, 20*b*, 20*c*, and 20*d*, for the roller 14 and by 22*a*, 22*b*, 22*c*, and 22*d* for the roller 16. Each pair of spools namely the pairs (20*a*, 22*a*), (20*b*, 22*b*), (20*c*, 22*c*), and (20*d*, 22*d*) supports a closed circuit or closed loop belt indicated by the references 24*a*, 24*b*, 24*c* and 24*d*, which is driven into a translation motion in the direction of arrow F by the driving means 18.

From the FIG. 1, it can be appreciated that, when the reel 10 is positioned onto the upper or operating reach of the belts the latter are bent downwardly forming something like a thin cradle or loop A onto which the bottom of the reel 10 abuts.

From the same FIG. 1 it can be noticed as well that the translation motion of the belts 24 in the direction of the arrow F causes by friction the unwinding of the band or strip of paper C from the reel 10, without need for the latter of being in whatever manner supported at the axis thereof.

Secondly it is worth to note that, once the necessary frictional relationship between the upper surface of the belts 24 and the paper forming the reel is established, as well as the distance along which such a contact must take place in order to have the unwinding occur safely, the translation speed of the belts 24 determines the unwinding speed of the paper band C from the reel 10.

In this connection it is also to be noted that the belts are preferably manufactured from a suitable material having a certain elasticity, such as semi-rigid rubber, the thickness thereof being selected depending on the material from a combination of these two elements depends at the very end the depth or height of the cradle A formed by the upper surface of the belts 24 will depend Obviously in order to ensure anyhow the forming of the said cradle, the distance between the axes of the axles of the rollers 14 and 16 is selected so as to be less by a predetermined value with respect to the length of the upper or operating reach of the belts 24.

Such a solution, however, is not compulsory, when only the natural elasticity of the material forming the belts 24 is exploited. This elasticity under the weight of the reel 10 determines, owing to a natural elongation of the belts, the forming of the said cradle.

It is lastly to be noted that by a simple mathematical calculation it can be verified that the unwinding speed of the paper band is independent from the mass of the reel 10, whereas determining importance has the height or deepness of the said cradle, this height as a matter of fact limiting this unwinding speed. For example, if the operating rate of a laser printer is taken into consideration, it being a typical example of a machine which may be served by an unwinding device according to the present invention, this unwinding rate is about 80 cm/second. For such an unwinding speed of the paper band C from the reel 10, the cradle A formed by the belts 24 must have a height of at least 4 cm, to prevent the translation motion of the belt from causing the reel to come out of the cradle.

With respect to the example given in the above paragraph, namely, 0.8 m/sec (80 cm/sec) for the peripheral speed, and using 9.806 for gravity acceleration g, there is found:

$$h>(0.8)^2/2 \times 9.806;\ h>0.033 \text{ m i.e. } h>3.3 \text{ cm}$$

Therefore, a value of h is given of 4 cm (in order to provide a reliable figure).

The above is based on the assumption that a body having a mass "m" (which in this case is the paper reel) is to be kept within a loop or cradle having a height "h" and with a peripheral speed "v" (expressed as m/sec), then this body has a kinetic energy originating from the motion with said peripheral speed "v" expressed by the formula "$\frac{1}{2}mv^2$".

In order to fulfill the condition, namely to prevent the body from coming out of the loop, then the kinetic energy must be less than the potential energy related to the height "h", which is expressed by the formula "mgh" (and corresponds to the work necessary to raise the mass m to the height h). Thus, the relationship to be fulfilled is:

$$\frac{1}{2}mv^2>mgh$$

Using this relationship to calculate the value "h" required to meet the above condition, it is found that $$h>mv^2/2mg;\ h>v^2/2\,g$$

It is thus seen that the height "h" is fully independent from the mass of the reel and is directly proportional to the unwinding or peripheral speed of the paper (which is also the linear speed of the unwinding belts if the losses due to friction are neglected) and is inversely proportional to gravity acceleration g which is a constant.

According to a preferred embodiment of the present invention, the basement 12 is positioned flush of the floor, so as to permit the reel 10 to be charged within the cradle formed by the belts 24 by rolling the reel around the axis thereof.

Often, however, it is necessary to substitute for the reel 10 which is being unwound with another one, for example or a different width, to meet the requirements of the downstream machine served by the unwinding device. The paper reels 10 as those involved by the present invention, have not negligible weight, of the order of the some hundred kilograms, whereby so that the cradle or loop A onto which the reel 10 abuts, even if already partially unwound, may present not negligible problems.

To this end the present invention provides within the basement or base 12 a number of idle rollers 26*a*, 26*b*, and 26*c* parallel to the belts 24 (*a, b, c* and *d*) and interposed between them, said rollers being supported at their ends by cylinder and piston means 28 (*a, b, c*) and 30 (*a, b* and *c*). In this manner, the roller assembly 26 (*a, b* and *c*) is movable between a lowered or disengaged position (shown in FIGS. 1–3) and a raised or operating position (FIG. 4 in the latter raised position, the reel 10 is disengaged from the cradle 10 and from the belt 24 (*a, b, c*) owing to the raising thereof.

Preferably in the raised position the roller assembly 26 (*a, b,* and *c*) brings or raises the bottom of the reel 10 to a position at the level of the floor in which the basement or base 12 is preferably embedded (so that it is below ground or floor level), whereby the reel 10 can be readily rolled away on the floor. The idleness of the rollers 26 (*a, b* and *c*) is moreover useful to permit cross-wise displacements of the reel 10 with respect to the translation direction of the belts 24 (*a, b* and *c*), for example to align one side of the reel and consequently the paper band C which is therefrom with a predetermined plane.

In this connection it is furthermore to be noted that both the basement or base 12 and the number and width of the belts 14 as well as of the rollers 26 are selected as a function of the maximum possible width of the paper band C and, consequently, of the reel 10 whereby it is necessary to be able to displace the reel 10 cross-wise with respect to the belts 24, particularly for sizes less then the maximum width, to adjust the alignment with the machine being served downstream.

Lastly the unwinding device according to the present invention is provided with banister means to sidewise retain the reel within the cradle or loop A without however rigidly engaging the reel.

These means comprise an upper side bar 32 and a lower side bar 34 connected by short posts 36, 38, the lower bar being supported from a box-like member having dampening springs. From the bars 32 and 34 adjustable pushers protrude, 40 and 42 respectively, having abutting plates 44 and 46. Against the latter plates the side of the reel 10 abuts.

The adjustability of the pushers 40 and 42 is important for the right positioning of the reel 10, as regards the exit position of the paper band C, whereas the elastic mounting of the bars 32 and 34 has the purpose of dampening side displacements of the reel during the unwinding thereof.

Figure 5:
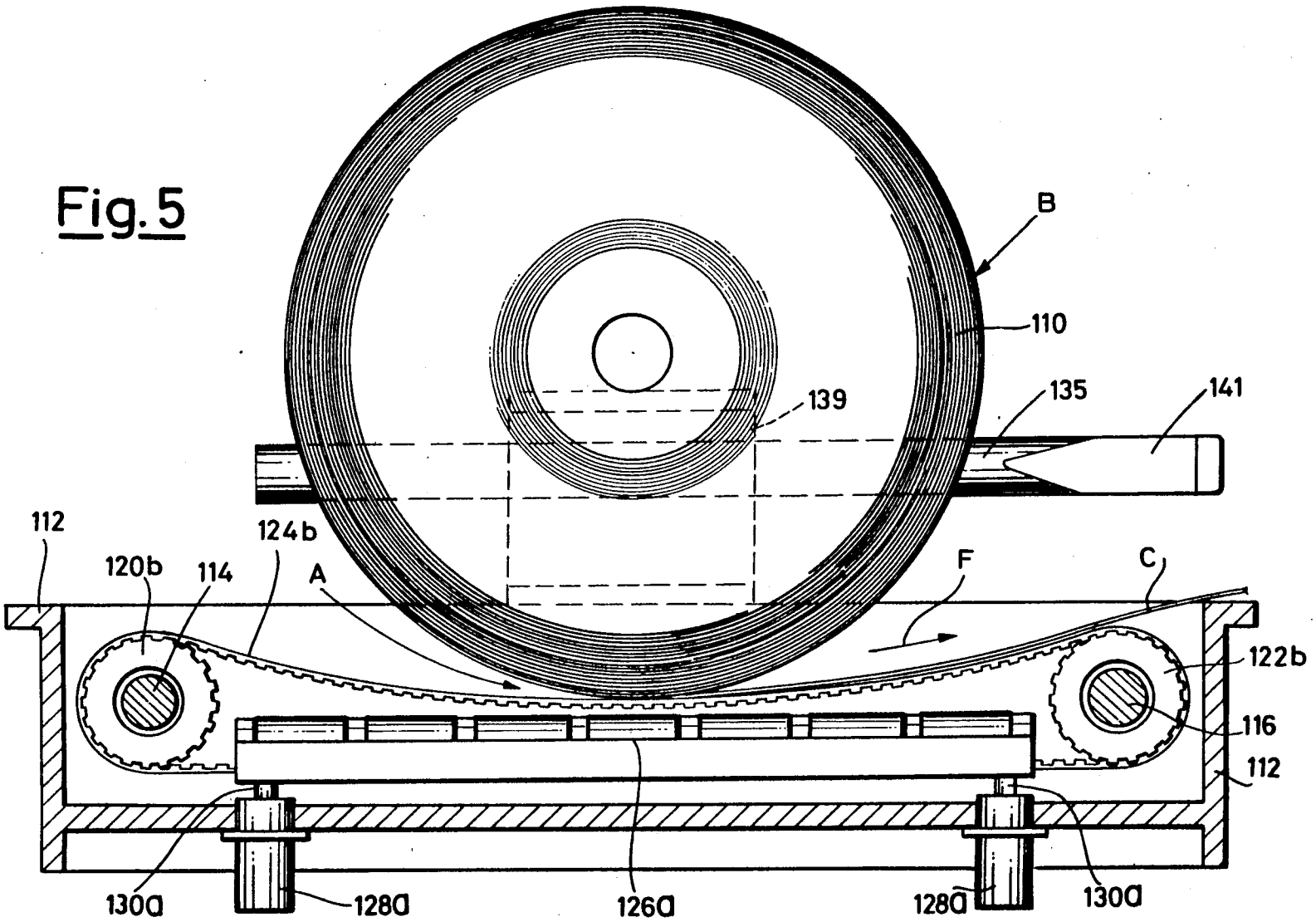
FIG. 5 is a side view, partially in cross-section, of the preferred embodiment of the device according to the present invention.
Figure 6:
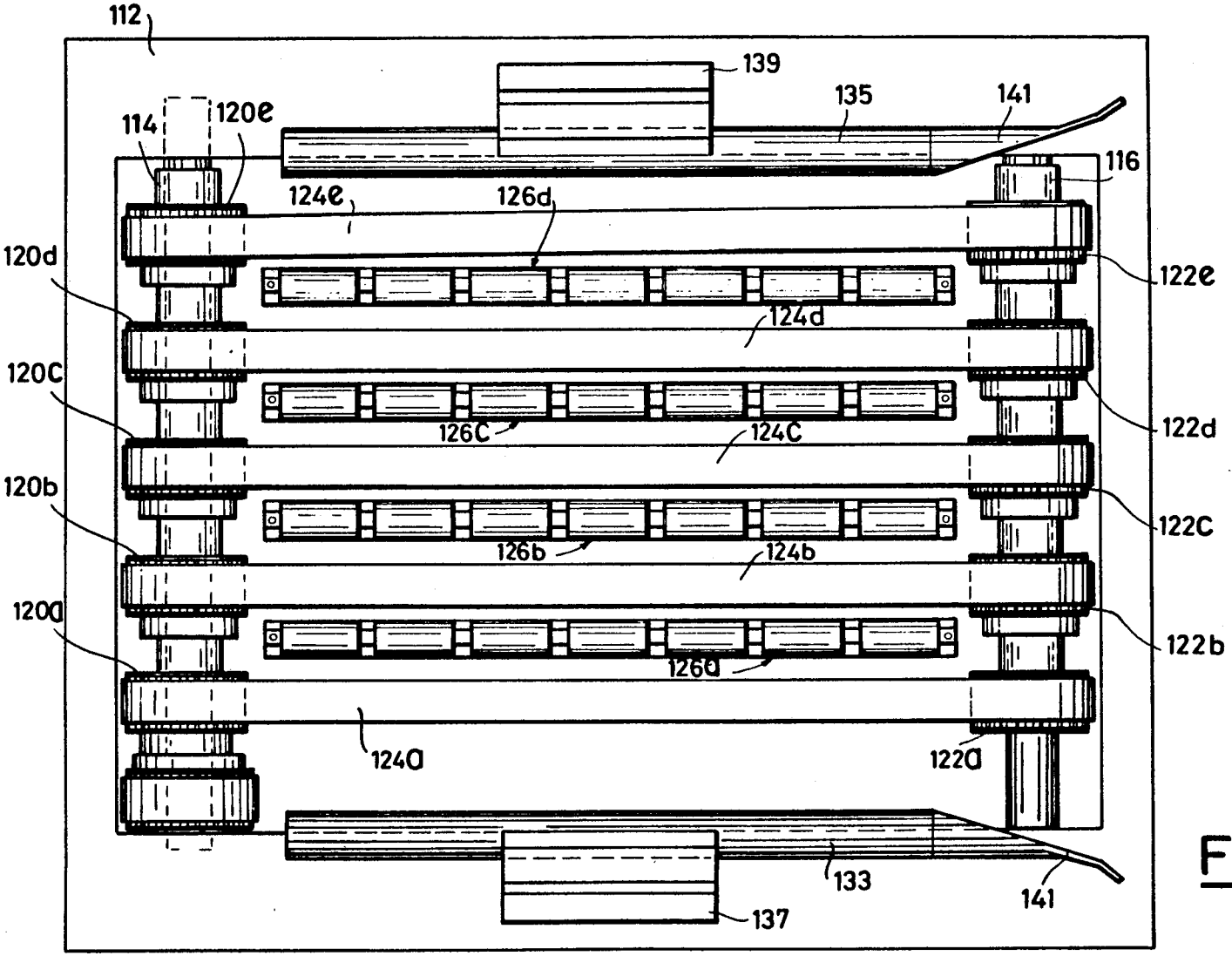
FIG. 6 is a plan view from above of the device shown in FIG. 5.
Figure 7:
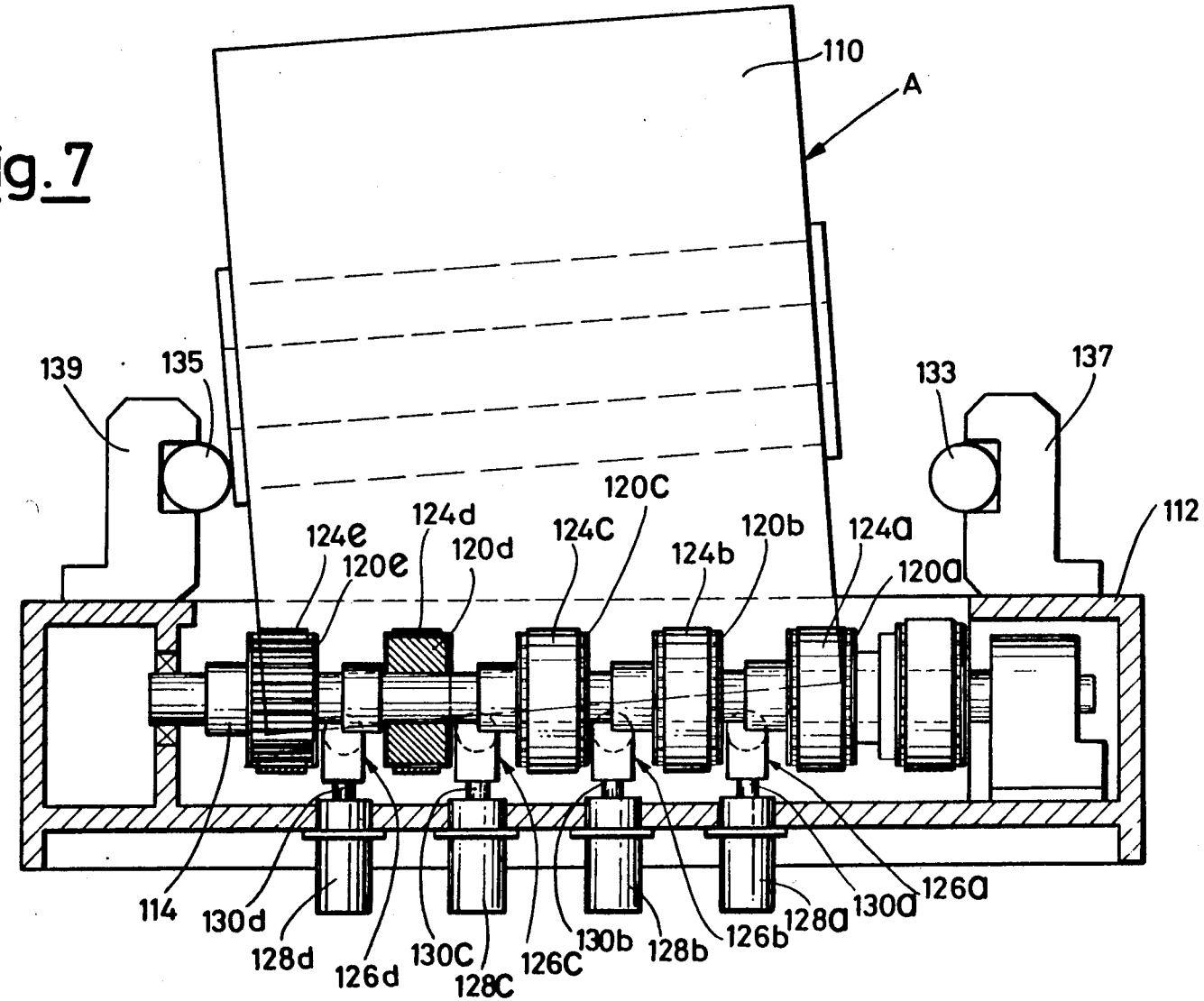
FIG. 7 is cross-section view, perpendicular to that of FIG. 5, showing in an enlarged manner for sake of illustration how the paper reel is positioned onto the unwinding device.
Figure 8:
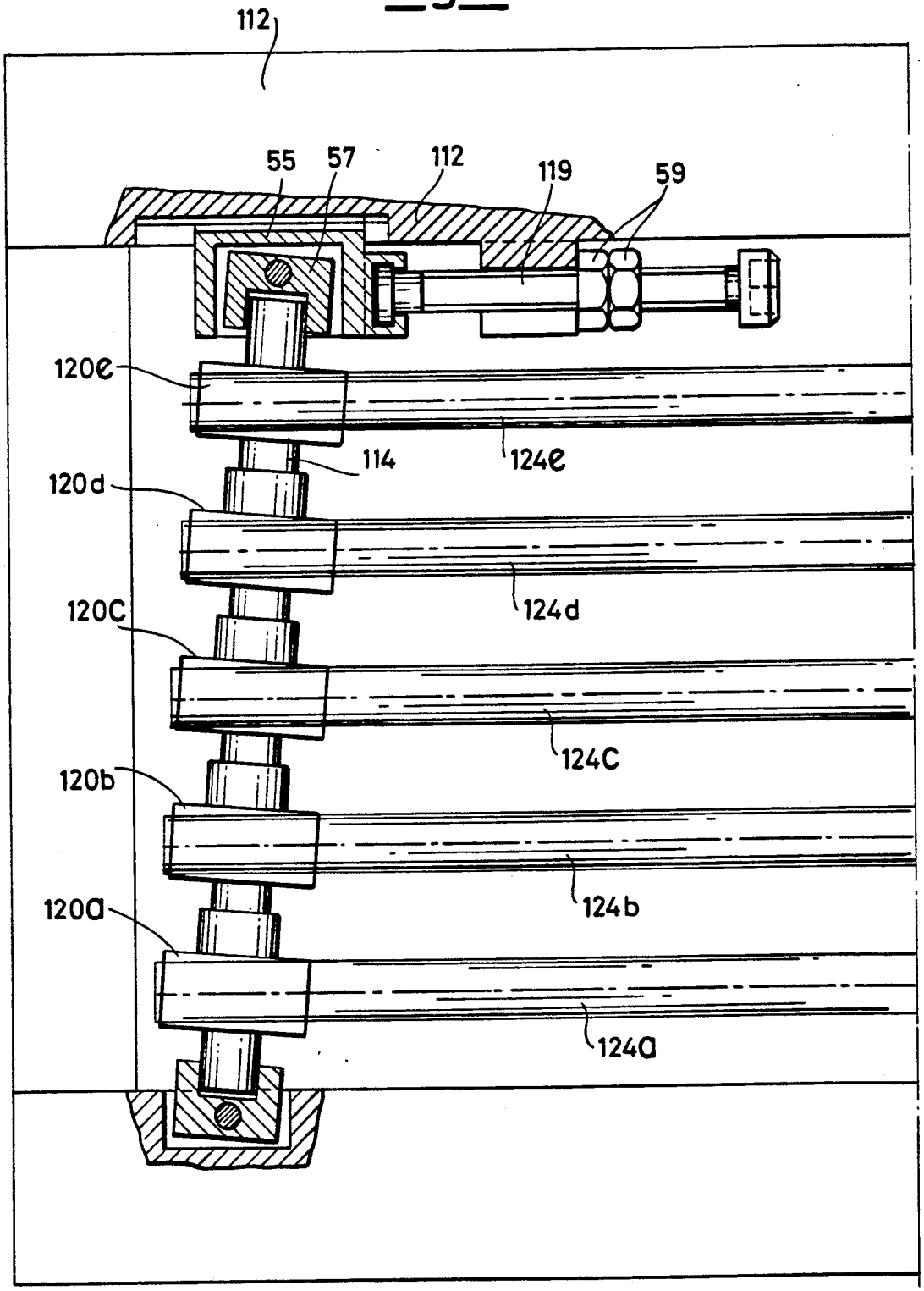
FIG. 8 is a partial plan view, like FIG. 6, showing another embodiment of the device according to the present invention.

Referring now to the FIGS. 5, 6, 7 in which where possible the same references as in the FIGS. 1–4 are used with an increase of 100 units, the device for the unwinding of paper reel 110 comprises a basement or frame 112 which at both ends supports rotatably two axles or rollers 114, 116, one of which is operatingly connected to a driving motor (not shown) for example through a proper gearing. These components are standard and it is not necessary to give a more detailed description or showing.

To each roller 114 and 116 a number of sprockets is mounted (in the FIGS. 5–7 in the number of five for each roller), indicated by the references 120 (*a,b,c,d,e*) for the roller 114 and 122 (*a,b,c,d,e,*) for the roller 116. Each pair of corresponding sprockets 120 and 122 is engaged by a toothed closed belt 124 (*a,b,c,d,e*) which is moved in the direction of the arrow F owing to the engagement with the toothing of the sprockets 120 and 122. From FIG. 5 it can be appreciated that by positioning the reel 110 onto the upper or operating reach of the belts 124, the latter are bent downwardly forming a loop or cradle A in which part of the reel abuts, the lowest generating line of which is ; consequently parallel to the generating line of the cradle or loop A as determined in the upper surface of the belts 124.

The translation motion of the belts in the direction of the arrow F, owing to the technical reasons already mentioned, causes by friction the unwinding of the band or strip of paper C from the reel 110 without the need of the supporting in any manner the reel at the axis thereof.

For the cross-wise displacement of the reel roller assemblies 126 (*a,b,c,d*) are provided, having cylinder and piston assemblies 128 (*a,b,c,d,*) and 130 (*a,b,c,d,*) for their raising and lowering between the rest position and the operating position.

In this case too the unwinding device is provided with side abutting means consisting of a pair of bars 133 and 135, supported by respective bracket 137, and 139 anchored to the basement 112, the bars 133 and 135 being tapered (as indicated by the reference 141) towards the entry end of the reel 110 onto the roller assembly and consequently within the cradle formed by the belts 124, to promote the loading of the reel.

As already discussed above, in order to ensure the alignment of one of the edges of the paper band C removed from the reel 110, the loop or cradle A formed by the belts 124 has a predetermined inclination with respect to the horizontal plane towards one of the sides of the basement, whereby the reel naturally tends to take a position sidewise displaced towards the said side and to remain in such position, thus ensuring that the line along which the corresponding edge of the paper band C comes out is constant.

In order to achieve such a purpose, in the embodiment shown in the FIGS. from 5 to 7, the length of each toothed belt 124 is progressively increased (respectively reduced) whereby the loop or cradle A formed by the belts shall have a greater height at the said side at which the belts 124 have greater length and respectively lower height at the opposite side.

In the showing of FIG. 7, in which such an inclination is exaggerated for sake of illustration, the belt 124*a* has a length less than that of the belt 124*b*; the latter in turn has a length less than that of the belt 124*c* and so on up to the last belt 124*e* which is that of greatest length. It is evident that the reel 110 tends to approach the side of the basement (base or frame) 112 corresponding to the belt 124*e*, up to touch the related abutting bar 135.

The translation motion of the belts shall cause the edge of the paper band coming out of the device to be aligned with said side, with which also the laser printer or other machine to be fed in a continuous manner with the paper band removed from the reel 110 shall be aligned.

According to the embodiment shown in the FIGS. 8, 9, 10 and 11, the same purposes is achieved without modifying the length of the transportation belts, but staggering the axis or the axles of roller 114 with respect to the condition of parallelism with respect to the axis or the axle of roller 116. To this end one of the ends of the roller 114 (which is selected only for example since the same reasoning holds true for the other roller 116 or even for both rollers 114 and 116) is mounted within a bracket 55, by means of a block 57, the bracket 55 being displaceable parallelly to the adjacent shoulder of the basement or frame 112 by means of a fine adjustment screw 119, anchored to the basement or frame 112 and which can be locked in the desired position by means of tightening nuts 59.

Figure 9:
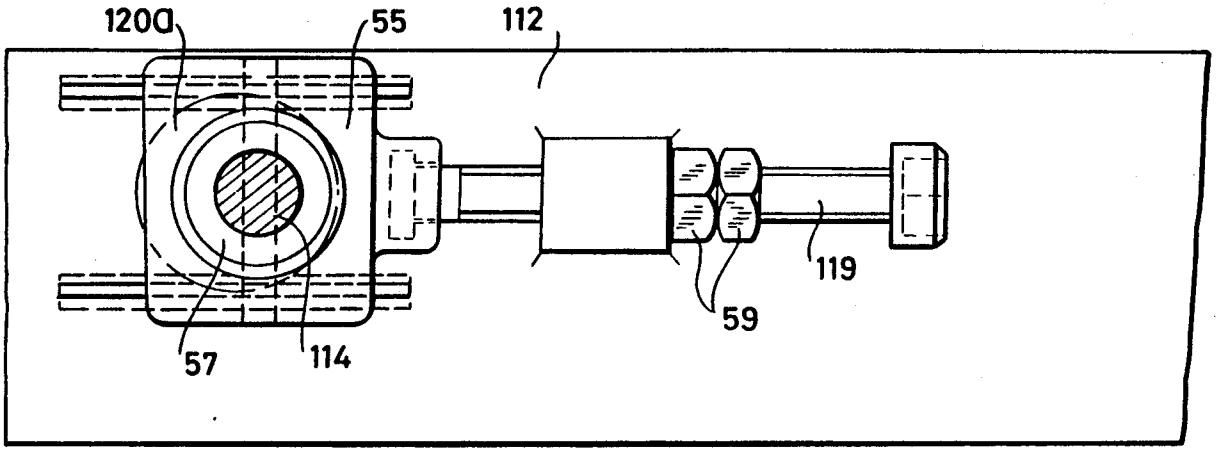
FIG. 9 is a view of a detail of the device of FIG. 8.

From FIG. 9 it can be readily appreciated that the displacement of the bracket 55 by means of the screw 119 causes the roller 114 to abandon the parallel condition with respect to the roller 116, whereby the belts 124, depending on their spacing from the fixed end, shall have an increased length cross-wise with respect to the device and the resulting loop shall be deeper with the technical consequences already described.

Figure 10:
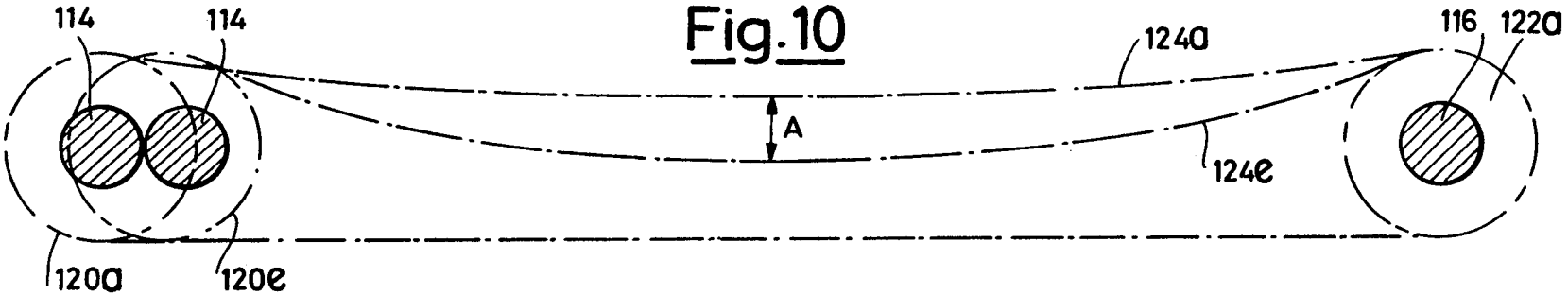
FIG. 10 is a schematic view of the operating principle of the device according to the present, invention.
Figure 11:
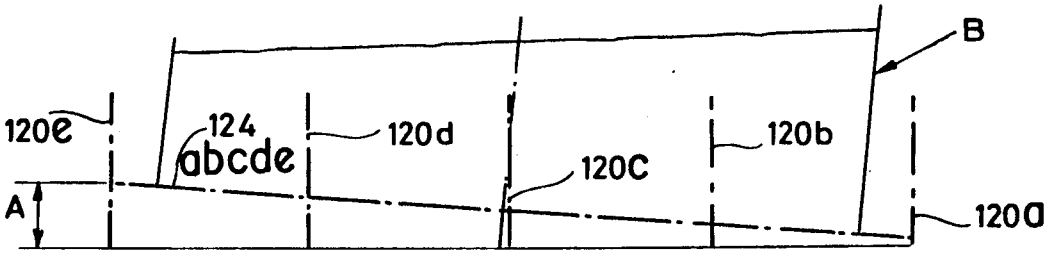
FIG. 11 is a view like FIG. 10 of the device seen cross-wise.
Figure 12:
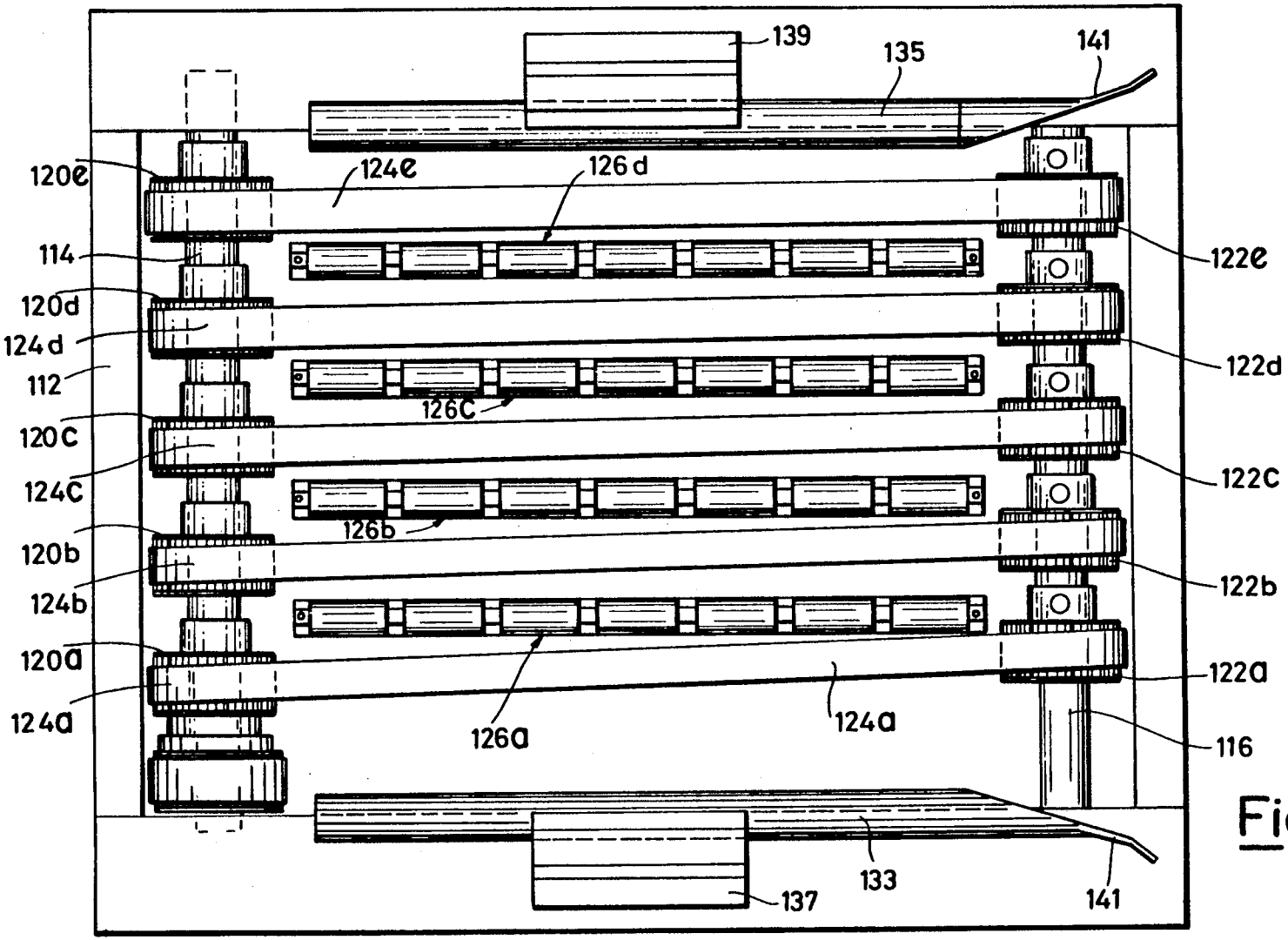
FIG. 12 is a view like FIG. 6 of a further embodiment of the device according to the present invention.

The FIG. 10 and 11 schematically shown what happens by staggering the roller 114 with respect to the roller 116. According to the embodiment shown in FIG. 12 the same technical result is achieved by staggering the single belts 124 with respect to the position of mutual parallelism. This result is achieved by displacing the sprockets 120 along the respective axes (114, 116), whereby the assembly of the belts 124 takes a trapezoidal shape starting from the original rectangular one.

From the above specification it is clear that the purposes of the present invention are achieved in a simple and effective manner.

The invention has been described with respect to preferred embodiments, and it is meant that modifications and variations conceptually and mechanically equivalent are possible and foreseable without falling out of its scope. Likewise the roller assembly and the related actuating mechanism may find equivalent solutions, such as for example a roller assembly adapted to engage from the underside of the upper reach of the unwinding belts, temporarily eliminating the loop or cradle A and bringing the reel 10 at the floor level. In that case, obviously, the rollers of the assembly shall be positioned perpendicularly to the translation direction of the unwinding belts. Moreover it is possible to substitute for the sprockets pulleys having variable and adjustable pitch in the same manner as the motion transmission belts of cars, whereby by adjusting the pitch of the pulley the length of the belt available to form the loop or cradle housing the reel B is determined.

I claim:

1. An unwinding device for a reel formed of uniformly continuous paper, comprising:

at least one belt of a material having some elasticity, said reel being formed of uniformly continuous paper to be unwound having a uniformly continuous surface abutting with a predetermined force with its uniformly continuous surface against a surface of said at least one belt;

means for driving said at least one belt with a translation motion having a predetermined and an adjustable speed, said surface of said at least one belt making frictional contact with a predetermined surface portion of said reel formed of paper, the free edge of a paper band forming said reel being directed in a translation direction of said at least one belt;

said means for driving of said at least one belt including means to form a loop or cradle within which said reel is freely abutting, based on the elasticity of the material forming said belt and of the friction coefficient between the belt surface and the paper forming the reel; and abutment means being provided in a sidewise position with respect to said at least one belt for controlling the position of an edge of the paper band forming the reel, said abutment means sidewise retaining the reel within the cradle free of rigidly engaging said reel, whereby the reel is supported without constraint for positioning of said reel as regards the exit position to permit the paper to exit with said edge in a uniformly continuous aligned condition with said abutment means so that the uniformly continuous paper comes out of the unwinding device in an aligned condition therewith.

2. The unwinding device according to claim 1, wherein said driving means includes a pair of spaced end rollers, one of said pair of spaced end rollers being coupled to a motor for rotation thereof and the other of said pair of spaced end rollers being idle, the distance between said pair of end rollers being less than half the whole length of said at least one belt by a predetermined amount to form said loop or cradle, and said predetermined amount being selected as a function of said elasticity and said friction coefficient.

3. The unwinding device according to claim 2, wherein said at least one belt includes a number of parallel and spaced belts, each forming a closed circuit and provided with said belt rotation means, and roller means being interposed between said parallel belts, said roller means having an axis parallel to the motion direction of said belts and being freely rotatable, said roller means being displaceable between a first rest or lowered position in which the upper generating line of the roller means is at a height less than the lowest point of said cradle formed by said belts, and a second operating raised position in which said reel is raised by said roller means, it being thus disengaged from the upper surface of said belts, and means for the displacement of said roller means between said two positions.

4. The unwinding device according to claim 3, wherein said roller means are displaceable between said two positions by means of cylinder and piston assemblies.

5. Unwinding device according to claim 2, wherein said at least one belt comprises a number of belts, and said inclination of said surface of said belts is obtained by staggering at least one roller of said pair of rollers with respect to the other roller of said roller pair.

6. Unwinding device according to claim 5, wherein said staggering is obtained by means of an adjustment screw controlling the displacement of a bracket supporting said end of said one roller, said displacement taking place in a direction parallel to an adjacent side of the device and to the translation direction of said belts.

7. Unwinding device according to claim 1, wherein said at least one belt includes a plurality of elastic belts, and the surface defined by said elastic belts is inclined towards one side thereof orthogonally to a translation direction of said belts along the uniformly continuous surface of said belts, whereby the paper reel abutting within the loop or cradle formed by said surface is pushed towards said side.

8. Unwinding device according to claim 7, wherein said inclination of said surface defined by said belts is obtained by sequentially varying the length of said belts from one side of the device to the other, the belt of greater length corresponding to the maximum depth of the said loop.

9. Unwinding device according to claim 7, including pairs of relatively displaceable means for carrying said belts and wherein said inclination is obtained by displacing one of said relatively displaceable means with respect to the other of said pair of relatively displaceable means, whereby the belts take on a trapezoidal contour.

10. An unwinding device for a reel formed of paper, comprising:

at least one belt of a material having some elasticity, the reel of paper to be unwound abutting with a predetermined force against a face of said at least one belt;

means for driving solely said at least one belt with a translation motion having a predetermined and an adjustable speed, said face of said belt making frictional contact with a predetermined surface portion of said reel of paper for imparting motion to said reel of paper, the free edge of the paper band forming said reel of paper being directed by said at least one belt in the translation direction of said at least one belt; and said means for driving of said at least one belt including means for movement of said at least one belt so as to form a loop or cradle within which said reel is freely abutting, the formation of said cradle or loop being a function of the elasticity of the material forming said at least one belt and of the friction coefficient between the belt face and the paper forming the reel; and said face defined by said at least one belt being inclined towards one side to the translation direction of said at least one belt, whereby the paper reel abutting within the loop or cradle formed by said face is pushed towards the same side.

11. The unwinding device according to claim 10, wherein said at least one belt comprises a plurality of parallel and spaced belts and each having a surface together forming a face, and each forming a closed circuit and provided with said belt rotation means, said belt movement means includes at least one pair of end rollers, one roller of said pair of end rollers being an idle roller and the other roller of said pair of end rollers being coupled to motor rotation means for rotation thereof, and the distance between the rollers of said pair being less than half the whole length of each said belt by a predetermined amount forming said loop or cradle, said predetermined amount being selected as a function of said elasticity of said material forming said surface of each of said belts and of said friction coefficient between the surface of said belts and the paper forming the reel.

12. The unwinding device according to claim 11, wherein said inclination of each said surface of said belts is obtained by staggering the axis of at least one roller of said pair of rollers with respect to the condition of parallelism with respect to the axis of the other roller of said roller pair.

13. The unwinding device according to claim 12, wherein said staggering is obtained by means of an adjustment screw controlling the displacement of a bracket supporting said end of said one roller, said displacement of said bracket displacing the axis of said one roller with respect to the axis of said other roller of said roller pair taking place in a direction parallel to an adjacent side of the device and in the translation direction of said belts.

14. The unwinding device according to claim 10, wherein said at least one belt comprises a plurality of belts each having a face facing in the same direction together forming a surface, and said inclination of said surface defined by said belts is obtained by sequentially varying the length of said belts from one side of the device to the other, the belt of greater length corresponding to the maximum depth of the said loop.

15. The unwinding device according to claim 14, wherein said plurality of belts are parallel to each other and side abutment means are provided in a sidewise position with respect to said parallel belts, and said side abutment means being engageable in abutment with said reel and free of constraint therewith.

16. The unwinding device according to claim 15, wherein said side abutment means consist of bars parallel to said belts and are provided with pushers adjustable in a direction parallel to the axis of the reel.

17. The unwinding device according to claim 10, wherein said at least one belt comprises a plurality of belts and said inclination is obtained by displacing one sprocket of a pair of sprockets with respect to an opposite sprocket of said pair of sprockets, such that one end of each said belt on said one sprocket of said pair with respect to the opposite one, whereby the belts take a trapezoidal contour.

18. The unwinding device according to claim 10, wherein said at least one belt comprises a plurality of parallel belts and side abutment means are provided sidewise positioned with respect to said parallel belts, said side abutment means being engageable only in abutment from said reel including bars parallel to said belts and provided with adjustable pushers in a direction parallel to the axis of the reel, whereby the latter is supported without constraint.

19. The unwinding device according to claim 10, wherein said at least one belt comprises a number of belts and the number and width of said belts is such that their whole cross dimension is greater than the maximum foreseeable paper size.

20. An unwinding device for a reel formed of uniformly continuous paper, comprising:

at least one belt of a material having some elasticity, said reel being formed of uniformly continuous paper to be unwound having a uniformly continuous surface abutting with a predetermined force with its uniformly continuous surface against a surface of said at least one belt;

means for driving said at least one belt with a translation motion having a predetermined and an adjustable speed, said surface of said at least one belt making frictional contact with a predetermined surface portion of said reel formed of paper for rotating thereof, said means for driving said at least one belt causing the free edge of a paper band forming said reel formed of paper to be directed in a translation direction of said at least one belt;

means for driving of said at least one belt including means to form a loop or cradle within which said reel is freely abutting, based on the elasticity of the material forming said belt and of the friction coefficient between the belt surface and the paper forming the reel; and abutment means being provided in a sidewise position with respect to said at least one belt for controlling the position of an edge of the paper band forming the reel, said abutment means guiding sidewise portions of said reel and sidewise retaining the reel within the cradle whereby the reel is supported free of constraint for positioning of said reel as regards the exit position to permit the paper to exit in a uniformly continuous surface formation of the uniformly continuous paper.

21. The unwinding device according to claim 20, wherein said belt rotation means is the sole means associated with said reel formed of paper for unwinding thereof and includes a pair of spaced end rollers, one of said pair of spaced end rollers being coupled to a motor for rotation thereof and the other of said pair of spaced end rollers being idle, the distance between said pair of end rollers being less than half the whole length of said at least one belt by a predetermined amount to form said loop or cradle, and said predetermined amount being selected as a function of said elasticity and said friction coefficient.

22. Unwinding device according to claim 21, wherein said at least one belt comprises a number of belts defining a surface, and inclination of the surface of said belts is obtained by staggering at least one roller of said pair of rollers with respect to the other roller of said roller pair.

23. Unwinding device according to claim 22, wherein said staggering is obtained by means of an adjustment screw controlling the displacement of a bracket supporting said end of said one roller, said displacement taking place in a direction parallel to an adjacent side of the device and to the translation direction of said belts.

24. The unwinding device according to claim 20, wherein said side abutment means includes bars parallel to said at least one belt and adjustable pushers adjustable in a direction parallel to the axis of the reel.

25. Unwinding device according to claim 20, wherein said at least one belt includes a plurality of elastic belts defining a surface, and the surface defined by said elastic belts being inclined towards one side thereof to a translation direction of said belts along the uniformly continuous surface of said belts, whereby the paper reel abutting within the loop or cradle formed by said face is pushed towards said side.

26. Unwinding device according to claim 25, including pairs of relatively displaceable means for carrying said belts and wherein said inclination is obtained by displacing one of said relatively displaceable means with respect to the other of said pair of relatively displaceable means, whereby the belts take on a trapezoidal contour.

27. Unwinding device according to claim 25, wherein said inclination of said surface defined by said belts is obtained by sequentially varying the length of said belts from one side of the device to the other, the belt of greater length corresponding to the maximum depth of the said loop.

* * * * *